US010328481B2

(12) United States Patent
Koenigbauer et al.

(10) Patent No.: US 10,328,481 B2
(45) Date of Patent: Jun. 25, 2019

(54) CLINCHING PUNCH AND APPARATUS

(71) Applicant: BTM Corporation, Marysville, MI (US)

(72) Inventors: Glenn R. Koenigbauer, Marine City, MI (US); Steven J. Sprotberry, Marysville, MI (US); Paul D. Boyes, Hillsborough (NZ)

(73) Assignee: BTM Company LLC, Marysville, MI (US)

( * ) Notice: Subject to any disclaimer, the term of this patent is extended or adjusted under 35 U.S.C. 154(b) by 1127 days.

(21) Appl. No.: 14/217,870

(22) Filed: Mar. 18, 2014

(65) Prior Publication Data

US 2015/0266080 A1 Sep. 24, 2015

(51) Int. Cl.

| | |
|---|---|
| ***B23Q 1/00*** | (2006.01) |
| ***B21D 39/03*** | (2006.01) |
| ***B21D 37/20*** | (2006.01) |

(52) U.S. Cl.

CPC ..... *B21D 39/031* (2013.01); *B21D 37/20* (2013.01); *Y10T 29/53996* (2015.01)

(58) Field of Classification Search

USPC ..... 29/243.5, 283.5

See application file for complete search history.

(56) References Cited

U.S. PATENT DOCUMENTS

| | | | |
|---|---|---|---|
| 567,606 | A | 9/1896 | McCool |
| 679,137 | A | 7/1901 | Baxter |
| 988,154 | A | 3/1911 | Thiemer |
| 1,190,696 | A | 7/1916 | Wilzin |
| 1,283,799 | A | 11/1918 | Kerr |
| 1,456,079 | A | 5/1923 | Stuebner |
| 1,509,997 | A | 9/1924 | Fry |
| 1,919,999 | A | 7/1933 | Borton |
| 1,926,686 | A | 9/1933 | Newton |
| 1,969,214 | A | 8/1934 | Dit Daude |
| 1,985,333 | A | 12/1934 | Wiley |
| 2,004,182 | A | 6/1935 | Arey |
| 2,254,558 | A | 9/1941 | Williams |

(Continued)

FOREIGN PATENT DOCUMENTS

| | | |
|---|---|---|
| AU | 206465 | 1/1957 |
| CA | 1237574 A1 | 6/1988 |

(Continued)

OTHER PUBLICATIONS

Attexor Clinch Systems SA, "Clinching Products," © 2002 [online], [retrieved on Nov. 7, 2008]. Retrieved from the Internet: http://www.clinchsystems.com/html, 22 pages.

(Continued)

*Primary Examiner* — Joseph J Hail
*Assistant Examiner* — Shantese L McDonald
(74) *Attorney, Agent, or Firm* — Harness, Dickey & Pierce, PLC

(57) ABSTRACT

A clinching apparatus includes a clinching punch having a specifically dimensioned tapered surface which improves the strength of a clinch joint created therewith. In another aspect, a tapered surface adjacent a distal end of a clinching punch has an angle of 20-35° relative to a distal end. A further aspect of a clinching apparatus provides a tapered surface adjacent a distal end which is configured in accordance with a specific formula.

16 Claims, 4 Drawing Sheets

(56) References Cited

U.S. PATENT DOCUMENTS 2,278,293 A 3/1942 Watson
2,333,966 A 11/1943 Weiss
2,393,986 A 2/1946 Gullberg
2,404,197 A 7/1946 Sirp
2,430,377 A 11/1947 Vorreyer
2,467,969 A 4/1949 Debrot, Jr.
2,555,836 A 6/1951 Werich
2,619,855 A 12/1952 Williams
2,626,687 A 1/1953 Williams
2,632,929 A 3/1953 Poupitch
2,663,072 A 12/1953 Pfistershamer
2,671,361 A 3/1954 Sandberg
2,685,719 A 8/1954 Golden
2,688,890 A 9/1954 Wiiliams
2,713,197 A 7/1955 Schmidt
2,811,880 A 11/1957 Williams
2,865,451 A 12/1958 Ihrig
2,924,312 A 2/1960 Williams
2,937,681 A 5/1960 Patten
3,022,687 A 2/1962 Richards
3,157,942 A 11/1964 MacLean, Jr.
3,177,914 A 4/1965 MacLean
3,178,749 A 4/1965 Heepe
3,187,796 A 6/1965 Double
3,198,155 A 8/1965 Fraze
3,202,112 A 8/1965 Oakley
3,315,345 A 4/1967 Double et al.
3,324,491 A 6/1967 Gutshall
3,338,463 A 8/1967 Henrickson
3,357,388 A 12/1967 Dunn
3,359,935 A 12/1967 Rosbottom
3,404,648 A 10/1968 Rosbottom
3,439,723 A 4/1969 Double et al.
3,451,367 A 6/1969 Henrickson
3,465,410 A 9/1969 Ernest et al.
3,469,613 A 9/1969 Steward
3,470,596 A 10/1969 Belada
3,506,050 A 4/1970 Pouch et al.
3,579,809 A 5/1971 Wolf et al.
3,599,318 A 8/1971 Behlen
3,615,274 A 10/1971 Belada
3,726,000 A 4/1973 Hafner
3,730,044 A 5/1973 Sawdon
3,740,818 A 6/1973 Grube
3,771,216 A 11/1973 Johnson
3,791,016 A 2/1974 Eberhardt et al.
3,810,290 A 5/1974 Grube
3,828,517 A 8/1974 Johnson
3,829,957 A 8/1974 Pouch et al.
3,862,485 A 1/1975 Hafner
3,865,047 A 2/1975 Hlinsky et al.
3,877,133 A 4/1975 Grube
3,885,299 A 5/1975 Hafner
3,900,937 A 8/1975 Schleicher
3,919,955 A 11/1975 DuVernay
3,920,059 A 11/1975 Grube
3,921,276 A 11/1975 Oaks
3,924,378 A 12/1975 Hafner
3,934,327 A 1/1976 Hafner
3,969,808 A 7/1976 Goodsmith et al.
3,981,064 A 9/1976 Hafner
3,999,659 A 12/1976 Grube
4,035,901 A 7/1977 Lux et al.
4,059,897 A 11/1977 Marquis
4,064,617 A 12/1977 Oaks
4,069,902 A 1/1978 Zdeb
4,094,352 A 6/1978 Hlinsky
4,153,989 A 5/1979 Shinjo
4,196,944 A 4/1980 Simatovich
4,203,187 A 5/1980 Grube
4,208,776 A 6/1980 Schleicher
4,237,567 A 12/1980 Grube
4,242,793 A 1/1981 Matthews et al.
4,269,248 A 5/1981 MacLean et al.
4,281,699 A 8/1981 Grube
4,306,511 A 12/1981 Ashby et al.
4,384,667 A 5/1983 Smallegan et al.
4,394,794 A 7/1983 Shirey
4,410,103 A 10/1983 Fuhrmeister
RE31,535 E 3/1984 Schleicher
4,459,735 A 7/1984 Sawdon
4,484,385 A 11/1984 Woods
4,525,912 A 7/1985 Kazino et al.
4,531,279 A 7/1985 Gunter
4,569,111 A 2/1986 Mutou
4,574,453 A 3/1986 Sawdon
4,574,473 A 3/1986 Sawdon
4,584,753 A 4/1986 Eckold et al.
4,601,090 A 7/1986 Gunter
4,610,072 A 9/1986 Muller
4,614,017 A 9/1986 Eckold et al.
4,633,559 A 1/1987 Loren
4,658,502 A 4/1987 Eckold et al.
4,660,403 A 4/1987 Slasinski
4,688,316 A 8/1987 La Barge et al.
4,722,647 A 2/1988 Sawdon
4,752,993 A 6/1988 Oaks
4,757,609 A 7/1988 Sawdon
4,803,767 A 2/1989 Obrecht et al.
4,825,525 A 5/1989 Obrecht et al.
4,831,704 A 5/1989 Rapp
4,831,711 A 5/1989 Rapp
4,878,284 A 11/1989 Sawdon
4,905,362 A 3/1990 Obrecht et al.
4,910,853 A 3/1990 Sawdon
4,928,370 A 5/1990 Eckold et al.
4,930,203 A 6/1990 Obrecht et al.
4,947,719 A 8/1990 Whistler
4,972,565 A 11/1990 Eckold et al.
5,010,714 A 4/1991 Medwed et al.
5,027,503 A 7/1991 Sawdon
5,031,442 A 7/1991 Kynl
5,046,228 A 9/1991 Eckold et al.
5,051,020 A 9/1991 Schleicher
5,138,758 A 8/1992 Gubbiotti et al.
5,150,513 A 9/1992 Sawdon
5,155,897 A 10/1992 Schleicher
5,177,861 A 1/1993 Sawdon
5,207,086 A 5/1993 Kynl
5,208,973 A 5/1993 Sawdon
5,208,974 A 5/1993 Sawdon et al.
5,230,136 A 7/1993 Cronn et al.
5,259,102 A 11/1993 Obrecht
5,267,383 A 12/1993 Sawdon
5,305,517 A 4/1994 Schleicher
5,315,743 A 5/1994 Schleicher
5,338,599 A 8/1994 Barrett
5,339,509 A 8/1994 Sawdon et al.
5,408,735 A 4/1995 Schleicher
5,425,262 A 6/1995 Dubugnon
5,431,089 A 7/1995 Sawdon
5,432,989 A 7/1995 Turek
5,435,049 A 7/1995 Sawdon
5,438,897 A 8/1995 Chun
5,479,687 A 1/1996 Sawdon
5,490,310 A 2/1996 Schleicher
5,509,290 A 4/1996 Faivre
5,528,815 A 6/1996 Webb
5,581,860 A 12/1996 Sawdon
5,621,961 A 4/1997 Schleicher
5,622,442 A 4/1997 Schleicher
5,695,867 A 12/1997 Saitoh et al.
5,709,019 A 1/1998 Sawdon
5,727,302 A 3/1998 Sawdon
5,737,819 A 4/1998 Sawdon et al.
5,782,130 A 7/1998 Sawdon
5,806,362 A 9/1998 Dubugnon
5,860,315 A * 1/1999 Sawdon ..... B21D 28/34 72/481.3
5,901,601 A * 5/1999 Fujimoto ..... B21D 5/01 72/347
5,946,782 A 9/1999 Dubugnon et al.
5,984,563 A 11/1999 Wu

(56) References Cited

U.S. PATENT DOCUMENTS

| | | | | |
|---|---|---|---|---|
| 6,062,413 | A * | 5/2000 | Redmond | B29C 51/08 206/469 |
| 6,092,270 | A | 7/2000 | Sawdon | |
| 6,115,898 | A | 9/2000 | Sawdon | |
| 6,205,640 | B1 | 3/2001 | Dubugnon | |
| 6,430,794 | B1 | 8/2002 | McKee | |
| 6,430,795 | B1 | 8/2002 | Sawdon et al. | |
| 6,450,082 | B1 | 9/2002 | Sawdon | |
| 6,612,007 | B1 | 9/2003 | Wade | |
| 6,684,479 | B2 | 2/2004 | Wang et al. | |
| 6,757,951 | B2 | 7/2004 | Sawdon et al. | |
| 6,785,959 | B2 | 9/2004 | Sawdon et al. | |
| 6,961,986 | B1 | 11/2005 | Muller | |
| 7,003,861 | B2 | 2/2006 | Sawdon et al. | |
| 7,681,296 | B2 | 3/2010 | Rapp | |
| 7,694,399 | B2 | 4/2010 | Sawdon et al. | |
| 8,142,098 | B2 * | 3/2012 | Hashimoto | F16B 4/004 29/521 |
| 8,261,424 | B1 * | 9/2012 | Thomeczek | B23P 11/00 184/105.3 |
| 8,650,730 | B2 | 2/2014 | Sawdon | |
| 8,955,364 | B2 * | 2/2015 | Breen | B21D 28/34 72/344 |
| 2004/0045153 | A1 | 3/2004 | Rapp | |
| 2005/0252269 | A1 | 11/2005 | Sawdon et al. | |
| 2006/0096075 | A1 * | 5/2006 | Robinson | B21D 39/031 29/521 |
| 2010/0018278 | A1 | 1/2010 | Trojer et al. | |

FOREIGN PATENT DOCUMENTS

| | | | |
|---|---|---|---|
| DE | 98517 | C | 10/1897 |
| DE | 2852909 | A1 | 6/1980 |
| DE | 3021332 | A1 | 12/1981 |
| DE | 3210208 | A1 | 9/1983 |
| DE | 3613324 | A1 | 10/1987 |
| DE | 3726392 | A1 | 2/1989 |
| DE | 4214475 | A1 | 11/1993 |
| DE | 4317278 | A1 | 12/1993 |
| DE | 4335318 | A1 | 4/1994 |
| EP | 642853 | A1 | 3/1995 |
| FR | 2371252 | A1 | 6/1978 |
| GB | 664979 | A | 1/1952 |
| GB | 708236 | A | 4/1954 |
| GB | 713625 | A | 8/1954 |
| GB | 895561 | A | 5/1962 |
| GB | 930164 | A | 7/1963 |
| GB | 934101 | A | 8/1963 |
| GB | 945110 | A | 12/1963 |
| GB | 1008914 | A | 11/1965 |
| GB | 1041119 | A | 9/1966 |
| GB | 1101795 | A | 1/1968 |
| GB | 1114826 | A | 5/1968 |
| GB | 1551353 | A | 8/1979 |
| GB | 2055648 | A | 3/1981 |
| JP | S54107868 | A | 8/1979 |
| JP | S54113753 | A | 9/1979 |
| JP | S5659540 | A | 5/1981 |
| JP | S62148035 | A | 7/1987 |
| JP | S62148036 | A | 7/1987 |
| JP | S62148039 | A | 7/1987 |
| JP | S62148040 | A | 7/1987 |
| JP | S63177931 | A | 7/1988 |
| JP | S63192524 | A | 8/1988 |
| JP | H04284928 | A | 10/1992 |
| SU | 1299699 | A1 | 3/1987 |
| WO | WO-9115316 | A1 | 10/1991 |
| WO | WO-9314893 | A1 | 8/1993 |
| WO | WO-9422613 | A1 | 10/1994 |
| WO | WO-0136124 | A2 | 5/2001 |

OTHER PUBLICATIONS

Attexor Clinch Systems SA, "Clinching Tool Kits," © 2002 [online], [retrieved on Oct. 28, 2008]. Retrieved from the Internet: http://www.clinchsystems.com/html.

Attexor Equipment, S.A., "Spot Clinch 67," 2 pages (prior to Jul. 22, 1994).

Attexor Supertagger, Sofort verbinden, ohne nieten, schrauben oder punktschweissen, 2 pages (published before Mar. 2014).

Böllhoff & Co, Verbindungs—und Montagetechnik, RIVSET® Stanzniettechnik, Standardsetzwerkzeuge, 2 pages (published before Mar. 2014).

Böllhoff & Co, Verbindungs—und Montagetechnik, RIVSET® Verbindung von Blechen und Profilen, 4 pages (published before Mar. 2014).

Böllhoff & Co, Verbindungs—und Montagetechnik, RIVSET-Stanzniettechnik, Prozeßüberwachung, 4 pages (published before Mar. 2014).

Böllhoff & Co, Verbindungs—und Montagetechnik, Systembeschreibung, RIVSET Magazinierte Stanzniete, 4 pages (published before Mar. 2014).

Böllhoff zum Thema Stanznieten, Warum sollen wir uns selbst loben, 4 pages (published before Mar. 2014).

BTM—Punch Tech Brochure, published Sep. 1983, 4 pages.

BTM Corporation Engineering Standards Manual—Section: D, Tog-L-Loc/Lance-N-Loc Information, Revised: Dec. 16, 2008, Rev 11, 46 pages.

BTM Corporation, "Typical Tog-L-Loc® Design Configurations," © 2009 BTM Corporation, [online], [retrieved on Feb. 2, 2009]. Retrieved from the Internet: http://www.btmcorp.com/tlconfigure.html, 4 pages (published before Mar. 2014).

BTM Lance-N-Loc and Tog-L-Loc Brochure, published prior to May 10, 1994, 1 page.

BTM's Tog-L-Loc and Lance-N-Loc Brochure, "Sheet Metal Joining Systems," published 1999. 16 pages.

De-Sta-Co, Durchsetzfüge-Technik Brochure, published 1993, 4 pages.

J.M. Sawhill, Jr. and S.E. Sawdon, A New Mechanical Joining Technique for Steel Compared with Spot Welding, SAE Technical Paper Series 830128, Feb. 28-Mar. 4, 1983, 16 pages.

Pressotechnik GmbH, "TOX Druckfugetechnik," 2 pages, (prior to Jul. 22, 1994).

Pressotechnik, "TOX Sammanfogningssystem," 2 pages, (prior to Jul. 22, 1994).

Pressotechnik, "TOX-Clinch Technik," 4 pages, (prior to Jul. 22, 1994).

*Tool Engineers Handbook*, American Society of Tool Engineers Handbook Committee, Detroit MI, First Edition, 1949, Section 97 (Punches and Dies) and Section 98 (Jigs and Fixtures), 86 pages.

TOX—Sheet Metal Joining System: Riveting without Rivets Brochure, published Sep. 2005, 23 pages.

TOX publication 262 Nr 4.1 entitled "Werkzeuge und Werkzeugkenngroβen," "Neue' Verbindungs-Verfahren im Vergleich," 2 pages (prior to Jul. 22, 1994).

BTM® Corporation; "Tog-L-Loc® Sheet Metal Joining System—Operating & Maintenance Manual;" 1988; 17 pages.

TOX® Pressotechnick L.L.C., "Overview of the TOX®—Clinching Technology—Data Sheet 80.100;" May 2008; 24 pages.

BTM Drawing No. 713800A entitiled "TL-3.0-940-N Punches" dated Nov. 21, 2013 (offered for sale in U.S. prior to Mar. 2014).

* cited by examiner

CLINCHING PUNCH AND APPARATUS

BACKGROUND AND SUMMARY

The present invention relates generally to clinching apparatuses and more particularly to a clinching punch and joint formed therewith.

It is known to use a punch and die to create a clinch joint between workpiece sheets. Such a device is disclosed in U.S. Pat. No. 5,177,861 entitled "Apparatus for Joining Sheet Material" which issued to Sawdon on Jan. 12, 1993, and is commonly owned with the present application. This patent is incorporated by reference herein. This prior device was a significant step in the industry but there is still room for further improvements.

Another clinching construction is disclosed in U.S. Pat. No. 5,727,302 entitled "Die and Punch for Forming a Joint and Method of Making the Die" which issued to Sawdon on Mar. 17, 1998, and is commonly owned with the present application. This is also incorporated by reference herein. This prior punch includes a 5° frusto-conical taper which was intended to advantageously prevent high stress concentrations and to improve the tool life during high pressure tool flexure misalignments.

In accordance with the present invention, a clinching apparatus includes a clinching punch having a specifically dimensioned tapered surface which improves the strength of a clinch joint created therewith. In another aspect, a tapered surface adjacent a distal end of a clinching punch has an angle of 20-35 degrees relative to a distal end. A further aspect of a clinching apparatus provides a tapered surface adjacent a distal end which is configured in accordance with a specific formula. Additional advantages and features of the present clinching apparatus can be ascertained from the following description and appended claims taken in conjunction with the present drawings.

DETAILED DESCRIPTION

Figure 1:
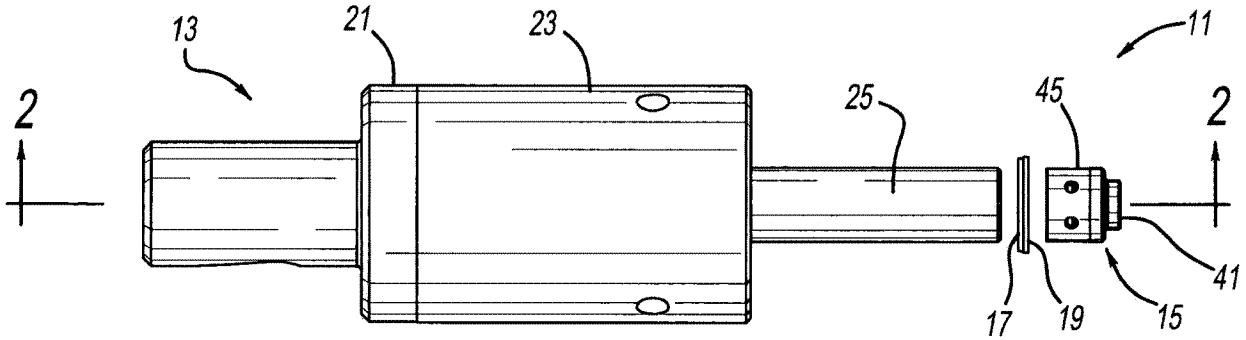
FIG. 1 is a side elevational view showing a clinching apparatus.
Figure 2:
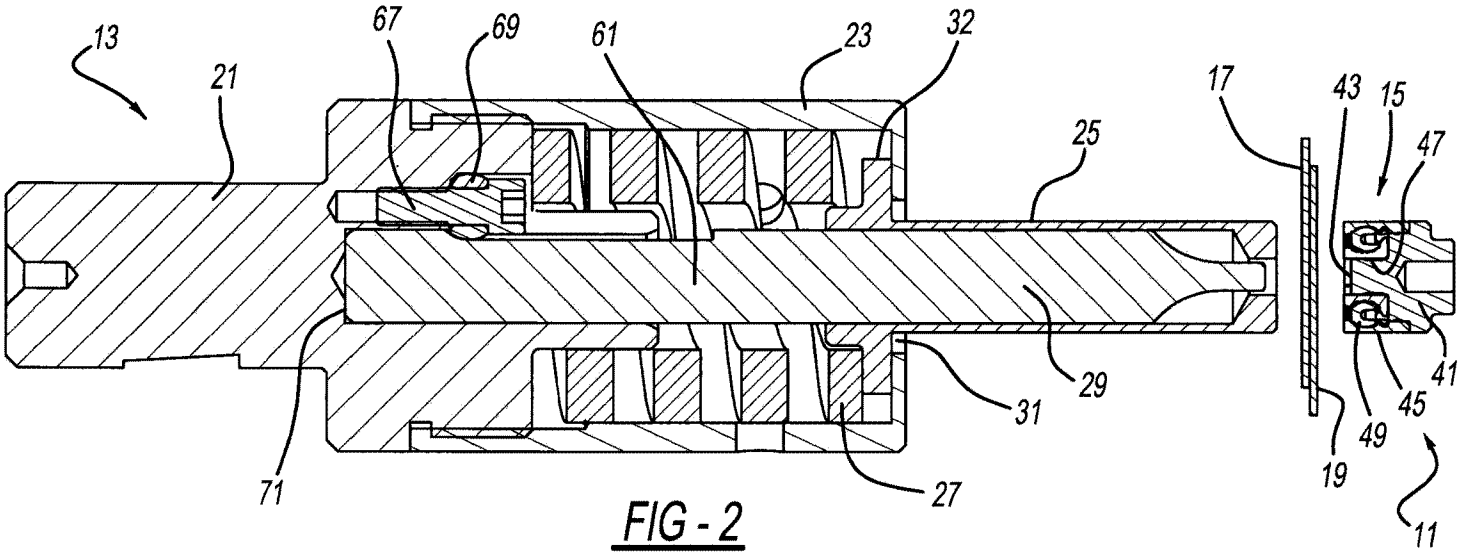
FIG. 2 is a cross-sectional view, taking along line 2-2 from FIG. 1, showing the clinching apparatus.
Figure 3:
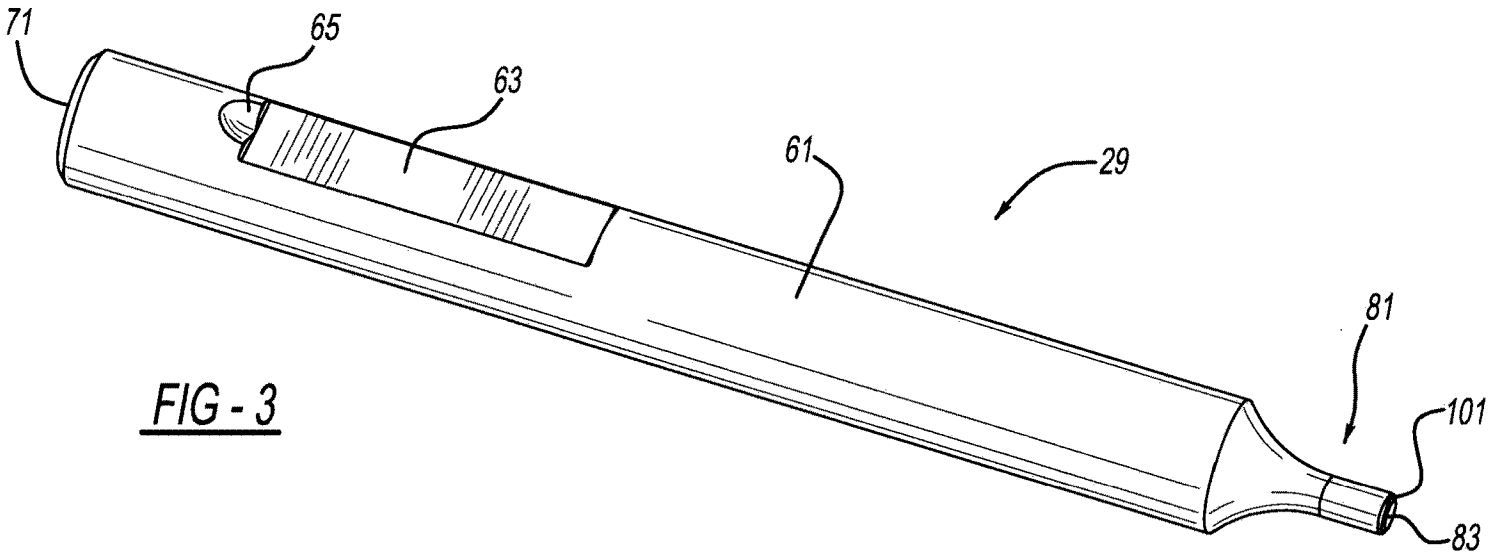
FIG. 3 is a perspective view showing a punch employed in the clinching apparatus.
Figure 4:
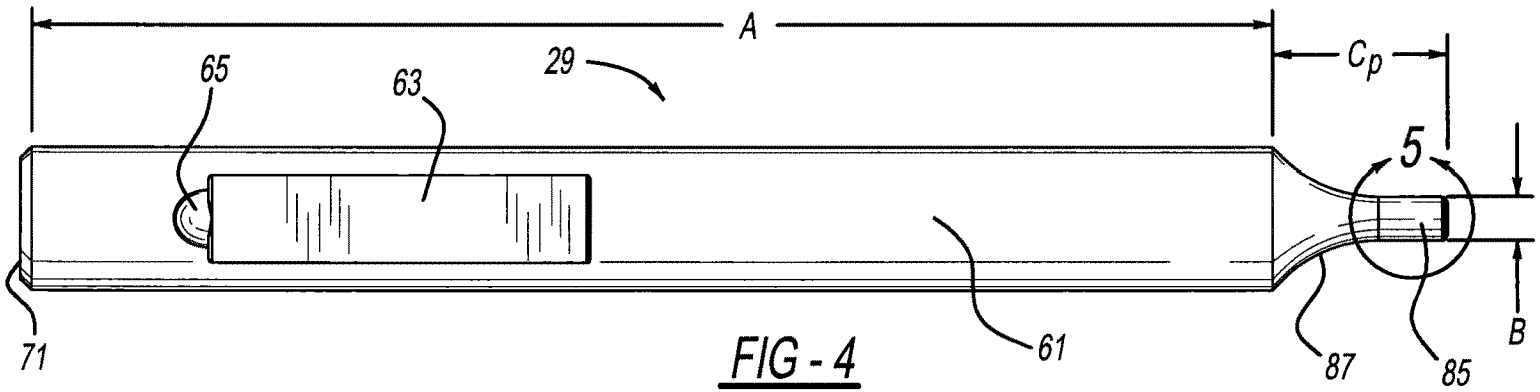
FIG. 4 is a side elevational view showing the punch.
Figure 5:
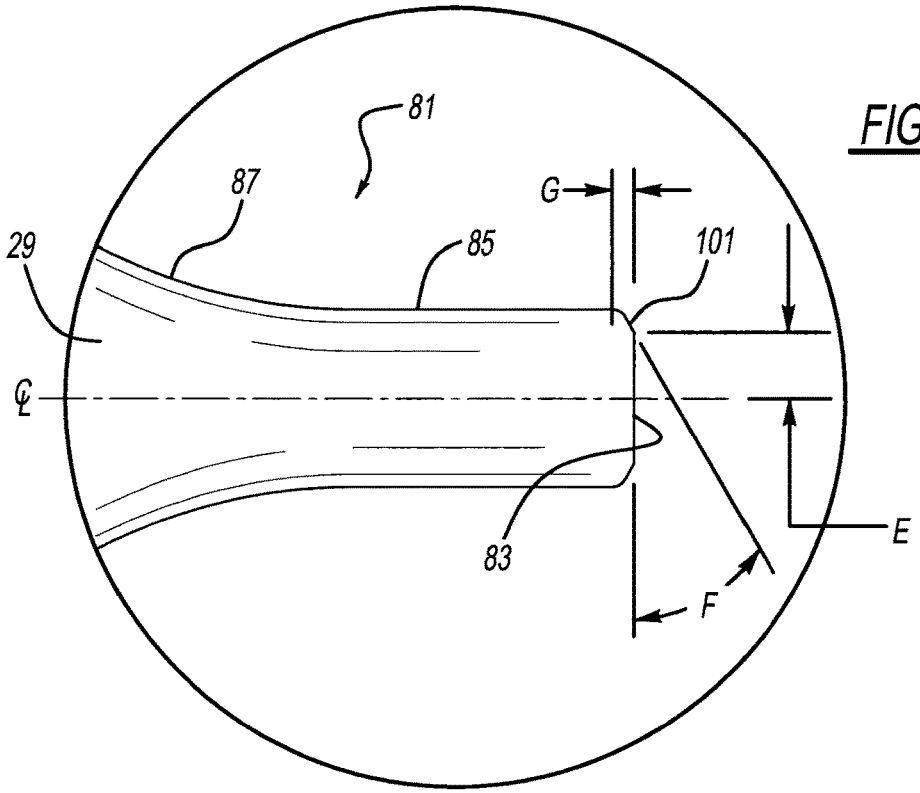
FIG. 5 is an enlarged side elevational view, taken within circle 5 from FIG. 4, showing the punch.
Figure 6:
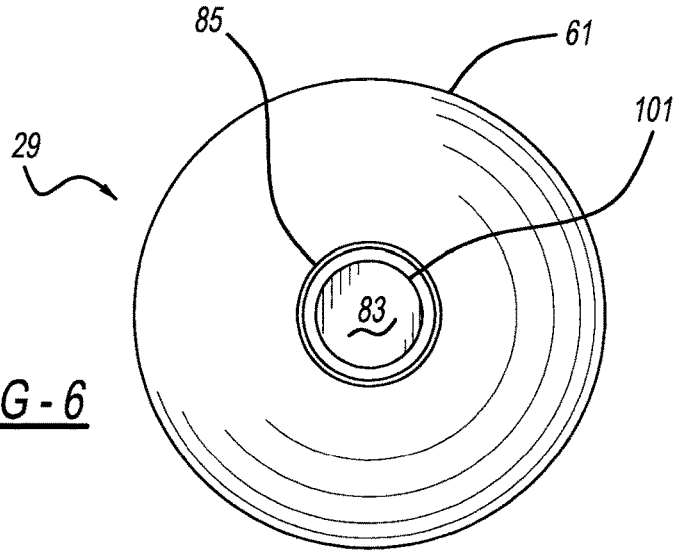
FIG. 6 is an end elevational view showing the punch.

Referring to FIGS. 1 and 2, a clinching apparatus 11 includes a punch assembly 13, a die assembly 15 and material workpiece sheets 17 and 19. Punch assembly 13 includes a punch holder 21, a hollow stripper retainer 23, a stripper 25, a helically coiled spring 27 and a punch 29. Retainer 23 is affixed to a periphery of holder 21, and stripper 25 is a hollow member, a section of which is linearly moveable through an aperture 31 of retainer 23. An axial length of stripper 25 is preferably greater than twice the diameter of an abutment flange 32 thereof. Spring 27 is located between flange 32 of stripper 25 and a facing surface of holder 21 so as to urge stripper 25 axially away from holder 21 but also allow stripper 25 to be compressed toward holder 21 during clinch joint forming when punch 29 is linearly advanced along its centerline and axial direction by a fluid powered actuator moving holder 21 and/or its attached frame. Exemplary actuators for moving either the punch or die are discussed in U.S. Pat. No. 6,115,898 entitled "Force Multiplying Apparatus for Clamping a Workpiece and Forming a Joint Therein" which issued to Sawdon on Sep. 12, 2000, and U.S. Pat. No. 8,650,730 entitled "Clinching Tool" which issued to Sawdon on Feb. 18, 2014, both of which are incorporated by reference herein.

Die 15 includes a body 41, and a fixed and stationary anvil 43 integrally upstanding from body 41. Furthermore, die 15 additionally includes a circular-cylindrical shield 45 attached to body 41 with a set of three movable die blades 47 located between a generally cylindrical side of anvil 43 and shield 45. A coiled spring 49, elastomeric O-ring or other biasing member is located between shield 45 and blades 47 so as to urge distal ends of the die blades toward the side of anvil 43. Punch holder 21 and die body 41 are fastened to a C-frame, fixture or other mechanism such that punch 29 and anvil 43 are always intended to be aligned with each other in all joint forming operating conditions in the preferred embodiment of the present punching apparatus.

Reference should now be made to FIGS. 2-6. Punch 29 includes a generally circular-cylindrical body 61 which is elongated in an axial direction defined by a centerline CL of the punch. A recess 63 has an axially elongated shape machined in a peripheral surface of body 61 with a partially spherical depression 65 located at a trailing end thereof. A threaded fastener 67 and surrounding partially spherical retention ball or collar 69 engage with recess 65 to secure punch 29 to holder 21 in a removable manner such that a proximal or trailing end 71 of punch 29 firmly abuts against holder 21.

Punch 29 further includes a clinch joint-forming tip 81 which ends in a distal or leading end 83. Tip 81 of punch 29 further includes a generally circular-cylindrical peripheral side surface 85 which is located between distal end 83 and an arcuately curved transition section 87. Distal end 83 and a section with surface 85 are the portions of punch 29 that enter into and create a recessed cup for the clinch joint in a punching and deforming action. It is noteworthy that surface 85 has a generally constant diameter B without any discontinuities or steps therein. Alternately, a very small draft angle can be provided on surface 85, but generally equal to 5° relative to the punch centerline. Moreover, arcuately curved section 87 may alternately have a frusto-conical shape thereto although various workpiece deformation or punch strength benefits may not be achieved.

A frusto-conical taper 101, annular in an end view, is located between distal end 83 and cylindrical side surface 85. Taper 101 preferably has an angle F of 20-35 degrees relative to end 83, more preferably 28-32 degrees, and most preferably 30 degrees for two workpieces 17 and 19 of differing thicknesses. Intersecting lines defined between sidewall surface 85, taper 101 and distal end 83 all have angular corners in one version, however, it is alternately envisioned that one or both of the intersecting corners can employ a radius no greater than 0.02 inch. Furthermore, N is a sidewall neck thickness NL or NR of punch-side workpiece 17, A is an axial length of body 61 of punch 29, E is a minor radius measured between centerline CL of punch 29 and an intersection between tapered surface 101 and distal end 83, $t_1$ is a minimum thickness of punch-side workpiece 17 at the bottom or button of the final clinch joint, and $t_2$ is a minimum thickness of die-side workpiece 19 at the bottom or button of the final clinch joint.

Figure 7:
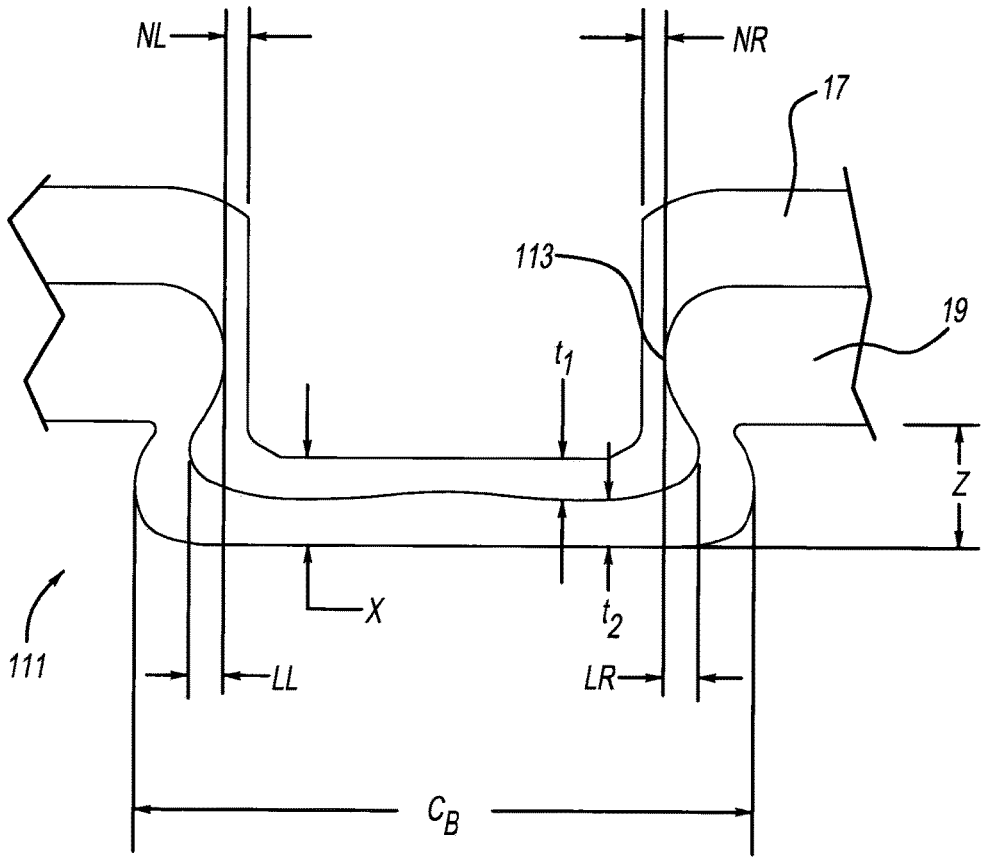
FIG. 7 is an enlarged diagrammatic view showing a clinch joint formed using the clinching apparatus.

Additionally, angle F for taper 101 of punch 29 is preferably determined according to the following formula regarding the desired final clinch joint 111 as illustrated in FIG. 7:

$$E = \frac{B}{2} - \frac{P_{thk}}{2}\left(\frac{1}{\tan F}\right)$$

where 2E is a minor diameter of side surface 85 where the tapered surface intersects distal end 83, B is a major diameter of side surface 85 where tapered surface 101 intersects side surface 85, $P_{thk}$ is a nominal (unclinched) punch-side workpiece 17 material thickness, and F is the angle of tapered surface 101.

The angular dimensions for the present taper 101 have been found to be significantly superior in joint performance as compared to conventional punch tips which have no taper or a mere 5° transitional taper, especially for a workpiece arrangement where punch-side workpiece 17 is less than half the nominal thickness of die-side workpiece 19 as measured prior to joint formation. One such arrangement is where workpieces 17 and 19 are mating components or housings in a refrigerator appliance, or alternately an oven appliance, a dish washer appliance, a clothes washer appliance, a clothes dryer appliance or the like. The specific tip dimensional ranges disclosed herein have been found to better control the workpiece material flow throughout the duration of the material joining process, especially creating a more constant and thicker punch-side workpiece thickness NL and NR at the most inwardly constricted diameter 113 of die-side workpiece 19 where the workpieces interlock together after full clinch joint formation. The further interlocking deformation areas are at LL and LR. In contrast, a traditional punch with no taper at the end-to-sidewall transition is prone to causing undesired tearing or piercing of the punch-side workpiece adjacent constricted diameter 113.

By way of further comparison for one example of the present apparatus, workpieces 17 (HRB 55, textured prepainted) and 19 (HRB 60) are both steel, where the punch-side workpiece has a nominal thickness of 0.19 inch and the die-side workpiece has a nominal thickness of 0.40 inch, clinched together by a punch with taper angle F of 30°. This construction was found to have a finished clinch joint peel strength of at least 25 pounds of force and with a shear strength of at least 75 pounds, while the conventional and untapered punch version had a peel strength of less than 15 pounds of force. In another example, 0.026 inch nominally thick stainless steel (HRB 71) was used for punch-side workpiece 17 with HRB 55 steel of 0.40 inch nominal thickness for die-side workpiece 19; this generated a peel strength of at least 60 pounds and a shear strength of at least 185 pounds for a 30° taper angle F on punch 29. In these examples, a diameter $C_B$ of a clinch joint outer button circular periphery is 0.188 inch, a button cap height Z is 0.038 inch, and a total button bottom thickness X is 0.021 inch. Furthermore, the preceding examples employed punch 29 with dimensions of A=3.937 inch, B=0.120 inch, $C_p$=0.480, E=0.044, F=30° and G=0.015 inch. It should be appreciated that these dimensions are simply exemplary and the dimensions may vary (although the joint performance may also then vary).

While the preferred embodiment of the present clinching apparatus has been disclosed, it should be appreciated that other variations are possible. For example, while three movable die blades have been disclosed, it should be appreciated that two, four or other quantities of die blades surrounding or partially surrounding an anvil of the die assembly may be employed although certain advantages of the present die may not be realized. Furthermore, a punch of a polygonal body periphery can alternately be used although certain manufacturing and cost advantages may not be obtained. The shapes of the punch holder, stripper, spring and stripper retainer can be varied, however, various advantages may not be realized. A moving anvil, fixed die blades, and the absence of the disclosed shield may alternately be used, although such an arrangement would forego many advantageous features of the present device. Additionally, aluminum and other workpiece materials may be employed with the present clinching apparatus although the exact dimensions may need to be slightly varied to account for the material flow differences. It should be appreciated that other modifications and variations may be made to the preferred apparatus without departing from the spirit and scope of the present invention.

The invention claimed is:

1. A clinching apparatus comprising:

a linearly movable clinching punch including a side and an end, a taper located between the side and the end, the taper having an angle of 20-35 degrees relative to the end and the taper including an annular end view shape;

the side, which is adapted to form an inside cavity of a clinch joint, being free of any step thereon;

a holder secured to a proximal end of the punch;

a stripper located adjacent a portion of the punch;

a resilient member biasing the stripper away from the holder;

a clinching die including a central anvil coaxially aligned with the punch, and upstanding die blades surrounding the anvil; and a clinch joint in multiple sheet metal workpieces created between the punch and the die;

wherein the side and taper are dimensioned according to:

$$E = \frac{B}{2} - \frac{P_{thk}}{2}\left(\frac{1}{\tan F}\right)$$

where 2E is a minor diameter of the side where the taper intersects the end, B is a major diameter of the side where the taper intersects the side, $P_{thk}$ is a nominal punch side-workpiece material thickness, and F is the angle of the taper.

2. The clinching apparatus of claim 1, wherein the multiple sheet metal workpieces are multiple appliance workpieces.

3. The clinching apparatus of claim 1, wherein:

the multiple sheet metal workpieces are sheet steel workpieces; and an inside corner of the clinch joint includes a frustoconical taper.

4. The clinching apparatus of claim 1, wherein the multiple sheet metal workpieces are sheet aluminum.

5. The clinching apparatus of claim 1, wherein the angle of the taper is 28-32 degrees relative to the end.

6. The clinching apparatus of claim 1, wherein the clinching end of the punch facing the die has a first peripheral diameter less than half of a second peripheral diameter of the proximal end of the punch opposite that of the clinching end.

7. The clinching apparatus of claim 1, wherein the multiple sheet metal workpieces are sheet steel workpieces of differing thicknesses clinched together by the punch and the die, and the clinch joint formed therebetween withstanding a peel force of at least twenty-five pounds, the workpieces being part of a washer or dryer appliance.

8. A clinching apparatus comprising:

a linearly movable clinching punch including a side and an end, a taper located between the side and the end, the taper having an angle of 20-35 degrees relative to the end and the taper including an annular end view shape;

a stripper located adjacent a portion of the punch;

a resilient member biasing the stripper;

a clinching die including a central anvil coaxially aligned with the punch, and upstanding die blades surrounding the anvil; and a clinch joint in multiple sheet metal workpieces created between the punch and the die;

wherein the side and taper are dimensioned according to:

$$E = \frac{B}{2} - \frac{P_{thk}}{2}\left(\frac{1}{\tan F}\right)$$

where 2E is a minor diameter of the side where the taper intersects the end, B is a major diameter of the side where the taper intersects the side, $P_{thk}$ is a nominal punch side-workpiece material thickness, and F is the angle of the taper.

9. The clinching apparatus of claim 8, wherein the multiple sheet metal workpieces are multiple appliance workpieces.

10. The clinching apparatus of claim 8, wherein:

the multiple sheet metal workpieces are sheet steel workpieces; and an inside corner of the clinch joint includes a frustoconical taper.

11. The clinching apparatus of claim 8, wherein the multiple sheet metal workpieces are sheet aluminum.

12. The clinching apparatus of claim 8, wherein the angle of the taper is 28-32 degrees relative to the end.

13. The clinching apparatus of claim 8, wherein the clinching end of the punch facing the die has a first peripheral diameter less than half of a second peripheral diameter of the proximal end of the punch opposite that of the clinching end.

14. The clinching apparatus of claim 8, wherein the multiple sheet metal workpieces are sheet steel workpieces of differing thicknesses clinched together by the punch and the die, and the clinch joint formed therebetween withstanding a peel force of at least twenty-five pounds, the workpieces being part of a washer or dryer appliance.

15. The clinching apparatus of claim 8, wherein the anvil is stationary relative to a surrounding cylindrical shield, and the die blades are moveable relative to the anvil and the shield.

16. The clinching apparatus of claim 8, wherein at least one of the workpieces is pre-painted prior to clinching contact between the punch and the die.

* * * * *